US005145222A

United States Patent [19]

Meyer

[11] Patent Number: 5,145,222

[45] Date of Patent: Sep. 8, 1992

[54] DEVICE FOR LOCKING TRACTOR TRAILER AND SEA-RAIL CONTAINER DOORS

[76] Inventor: Lester E. Meyer, Rte. #1 Box 37, Damon, Tex. 77430

[21] Appl. No.: 739,083

[22] Filed: Aug. 1, 1991

[51] Int. Cl.[5] ..... E05C 19/18

[52] U.S. Cl. ..... 292/258; 70/202; 292/218

[58] Field of Search ..... 292/259, 258, 288, 218; 70/202, 18, 94, 236

[56] References Cited

U.S. PATENT DOCUMENTS 2,514,738 7/1950 Brodley ..... 292/258
3,245,239 4/1966 Zaidener ..... 70/202
4,372,136 2/1983 Mickelson ..... 70/238 X
4,602,720 7/1986 Mattsson ..... 292/259 R X
4,972,693 11/1990 Inouye ..... 70/238
4,977,974 12/1990 Brown ..... 70/226

*Primary Examiner*—Richard E. Moore
*Attorney, Agent, or Firm*—Gunn, Lee & Miller

[57] ABSTRACT

For use with a trailer having left and right overlapping doors, and also door rods which lock the doors, a clamp formed of mating, telescoping hollow tubular member supports identical L shaped hooks. The hooks encircle the door rods and secure the doors. The tubular members join and lock by a key operated removable cylinder in selected and aligned holes in the tubular members.

9 Claims, 1 Drawing Sheet

FIG. 1
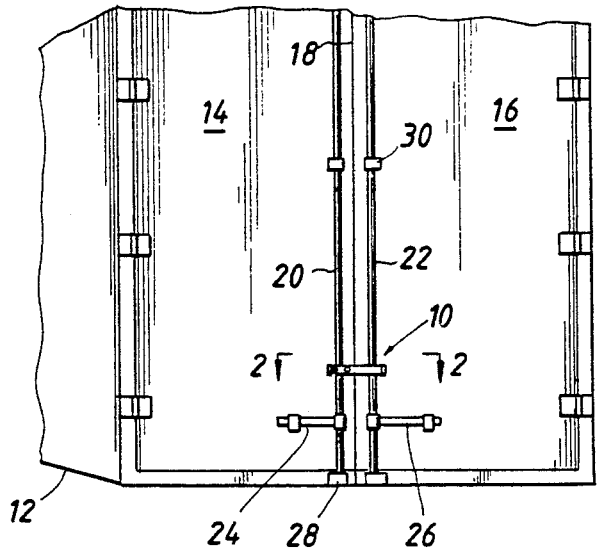
FIG. 2
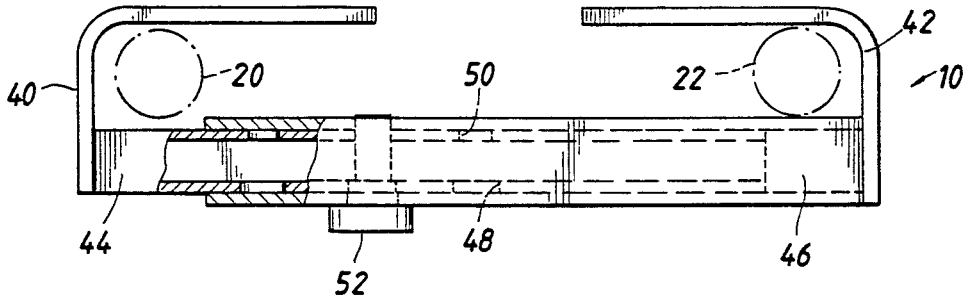
FIG. 3
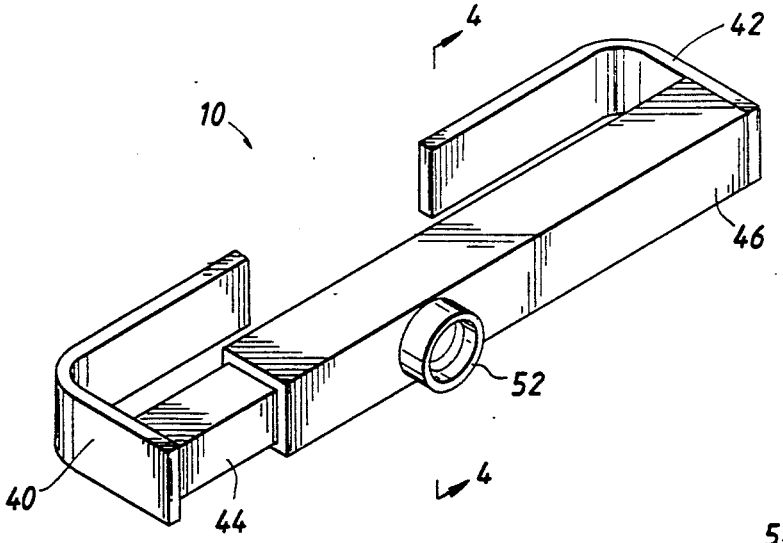
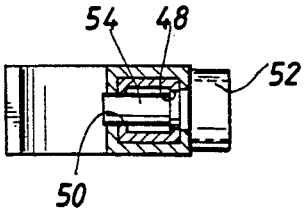
FIG. 4

DEVICE FOR LOCKING TRACTOR TRAILER AND SEA-RAIL CONTAINER DOORS

BACKGROUND OF THE DISCLOSURE

Large enclosed containers or trailers borne by a common mode of cargo movement tractor trucks, railroad flatcars, barges, and ships are familiar sites. A large portion of commercial goods are transported in such containers. The predominant cargo in these containers are goods packaged in cardboard cartons. By stacking the cardboard cartons on wooden pallets, the goods can be conveniently loaded into the rectangular, truckable containers. Often a forklift is used to move the heavy or bulky loads into and out of the container because the container is large enough to permit the entry of a loaded forklift. By such means, a manufacturer can load a container at the manufacturing plant or warehouse location and a warehouseman can unload palletized goods from the container at the destination of the goods without the need to unload the container. The container itself may pass through several intermediate transport companies and be borne by several different vehicles (e.g., barge, truck or train) before the goods themselves reach their final destination. For instance, the container may be first borne aboard a tractor trailer, then stacked on an inland waterway barge, then stacked in the hold of an oceangoing ship, later loaded on a railroad flat car, and finally loaded again on a tractor trailer for transport to a local warehouse or store. This is commonly known as containerized shipping.

The container itself offers weatherproof enclosure of the palletized, boxed goods, and case of intermediate handling by shippers. Containers offer relatively secure shipment of all types of goods, ranging from inexpensive perishables such as vegetables (in refrigerated trailers) to expensive, fragile electronic devices, such as computers.

As with any enterprise which involves the shipment and storage of valuable items to or through relatively unpopulated or unattended areas, thieves and vandals sometimes break into the closed containers. The containers themselves have rear doors for access which are built in accordance with a relatively common standard. The two large doors bisect one of the two smallest sides of the container to define the normally vertical doors exemplified in this disclosure. These doors normally open outward. Large rotating vertical rods are affixed to the doors and are used to latch and secure the doors in the closed position. One or more rods are affixed to each of the doors in aligned socket loops to permit rod rotation. The rods are mounted parallel to one another, near to the edges of the doors where the doors abut together and overlap when they are closed.

When the rods are rotated to a particular position, small flared latches on the upper and lower ends of the rods latch within and against open box like receptacles on the top and bottom frame edges of the container body so that the doors may be snugged down tight. Handles on the rods are rotated upward from their normal positions and move perpendicular to the rods. Hence when the doors are closed, an operator can rotate the rods to clasp the doors down tightly, lifting the handles near the end of the rotation and then drop the handles into latches on the door face so that they are again perpendicular to the rotating rods. This feature prevents the rods from rotating once the doors are snugged down tightly.

In the standard container door configuration, the rods themselves are not lockable by any built-in means or add-on device such as a common padlock. To prevent unauthorized entry, container shippers often buy "after-market" locks and hasps to secure the container doors. One common such device is an ordinary steel hasp which utilizes a padlock. Brammel, Inc. sells one such locking device. This device is in two halves, each affixed to one door and aligned so that, when the doors are closed, the two halves abut together and the loop portion of a padlock can be passed through holes drilled into the matching surfaces of the hasp. The disadvantage of such a device lies in the fact that the loop of the padlock is exposed and readily accessible to a thief or vandal possessing bolt cutters. By means of such common heavy duty bolt cutters, the loop of the padlock can be snipped and the padlock defeated.

One other common device is an adjustable lock consisting of two matched halves, one of which travels in grooves of the other half, allowing the width spanned by the lock to be adjusted. Brammel, Inc. also sells such a locking device. The halves of the device are approximately four inches wide. One of the halves has a rounded, ribbed longitudinal spine along its major axis which allows the loop of a padlock to fit between the protuberances of the spine to prevent movement of the two halves relative to one another once the padlock is in place. The outer ends of the locking device form a semi-circle so that they slip over and grip the parallel rods on the container doors. Hence by slipping the two halves of the device over the rods of the container door, bringing the two halves together by stabbing one of the halves into the grooves of the other half, and finally slipping a padlock over the longitudinal ribbed spine of one of the halves, the device becomes locked around the rods of the container door. Although this device is more difficult to defeat than the hasp device, the loop of the padlock is still relatively exposed and can be snipped by bolt cutters.

BRIEF SUMMARY OF THE PRESENT DISCLOSURE

The present disclosure is directed to a locking device which reaches around and clasps the two parallel vertical rods which lock the back doors of a container, and it secures the two vertical rods together. This prevents opening of the container. Moreover, the device of the present disclosure is adjustable in width so that it will accommodate a trailer which is constructed off standard, meaning one where the vertical locking bars have a different spacing. The device can be expanded through a range to thereby accommodate such nonstandard constructions. In the device of this disclosure, the lock mechanism that is exposed to a thief is constructed of hollow bar stock, the preferred bar having a cross sectional area which is square or rectangular, and is sufficiently large in cross section that it is pratically impossible to grasp the lock mechanism in the throat of the cutting edges of a bolt cutter which is otherwise used to defeat typical padlock constructions. The device is symmetrical in that there are identical left and right hooks which reach around and behind the locking rods on the truck door. Further, it is constructed with telescoping tubular frame members, the two telescoping frame members fitting together to provide an extra thick construction. They are held at a specified locked position by means of a key operated lock which is completely recessed within the tubular frame members. This shields the lock from easy access so that it is in a safe location.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 shows the lock of the present invention installed to close the overlapping back doors of a cargo container where the lock latches around a pair of vertical rods constructed on the doors for latching the doors;

FIG. 2 is a sectional view along the line 2—2 of FIG. 1 showing details of construction of the lock mechanism of the present disclosure and in particular illustrating telescoping tubular frame members which slide together to adjust in width;

FIG. 3 is a perspective view of the lock mechanism shown in FIG. 2 further showing how similar hooks extend behind the rods on the door to latch the two doors together; and FIG. 4 is a sectional view through the lock receiving receptacle in the frame members showing how the lock mounts to the two frame members for securing the container.

DETAILED DESCRIPTION OF THE INVENTION

The patentable device disclosed herein is an improved adjustable locking device for container or trailer rear doors. The new locking device is designed so that its two mating halves grasp the two parallel vertical rods of the container doors described above and lock together so that the doors cannot be opened by unauthorized persons. The device is made of a suitable hard metal alloy, selected so that the device is sufficiently durable to resist cutting, abrasion, and corrosion.

The main body of the device comprises rectangular hollow metal tubular stock which enables the two major portions to mate so that one slips easily but securely inside the other. Each of the tubes is about eleven inches long but longer versions can be made. The two tubes should in any case be sufficiently long to span the distance between the parallel, rotating or locking rods on the container doors. However the tubes are shortened by telescoping so that the device can shorten to close over the container door rods and grasp them securely when the smaller tube telescopes as deeply as possible inside the larger tube.

Going now to FIG. 1 of the drawings, the latch mechanism of the present disclosure is indicated generally by the numeral 10 and is fastened on the back of a cargo container 12. The container has left and right doors 14 and 16. The doors are hinged at the remote vertical edges to swing open to provide access to the container. The container is constructed typically in accordance with conventional dimensions for this type of cargo carrier. The doors 14 and 16 overlap to define a seam 18. The doors are held in a closed position by operating the vertical rods 20 and 22. These are constructed in accordance with the industry standard to provide door operating latches. They are rotated by means of laterally protruding handles 24 and 26. On rotation, they move end located latches into latch engaging pockets at 28. Since there are two rods and each end of the rods is provided with such a mechanism, there are four cooperative latches and four cooperative latch receiving pockets. The vertical rods thus move to latch and unlatch the doors so that the doors can swing open. The vertical rods are supported on door mounted eyelets 30 at one or more locations along each of the rods to support them loosely. They are able to move upwardly and downwardly and also rotate. This assists in closing and latching the doors and securing the doors against entry.

Thieves ordinarily achieve entry by breaking any lock mechanism securing the two rods together. Various and sundry mechanisms are provided including such things as door mounted locks which hold the rods 20 and 22 as well as the horizontal arms 24 and 26. Other mechanisms have been attempted, but generally, they have failed because they are unable to hold the rods against the assault of thieves equipped with typical tools of such thieves. One of the most common tools is a long handled bolt cutter which has sufficient leverage and sufficiently sharp teeth to pinch and cut the hasp of a padlock. At times, seals of the sort used by taxing authorities, custom agents, and the like have been installed, but they are also easily destroyed and they do not really provide physical exclusion to thieves.

Going now to FIG. 2 of the drawings, the lock mechanism of the present disclosure shown in better detail. It incorporates an L shaped hook 40 at one end and a very similar hook 42 at the opposite end. They are sized so that they reach around and hook behind the vertical rods 20 and 22 as illustrated in FIG. 1 of the drawings. The left hook 40 is affixed to a first tubular or frame member 44. It has a hollow tubular construction which is either square or rectangular in cross section. It is of substantial length and is ideally formed of hollow tubular stock as mentioned. By contrast, the opposite tubular member which telescopes over the first tubular member 44 is somewhat larger, and is approximately the same length. Accordingly, the hook 42 at the right is joined to the similar rectangular tubular member 46. The two tubular members are thus telescoped together in the illustrated fashion of FIG. 2 of the drawings.

The walls of both tubes are sufficiently thick to give the mated assembly of the device strength for resisting attempts to break or bend the device. The walls are typically about two tenths of an inch (0.2") thick greater. On the end of each tube, welding or other suitable means attaches the broad flat piece of metal curved to form the hooks 40 and 42 that grasp the container door rods 20 and 22. The two major inside surfaces of these clasping hooks 40 and 42 connect at a ninety degree angle, and the radius of curvature at the inside surface of the hooks is selected to approximate the typical radius of the container door rods. Typically, this radius is about 0.60 inch. The hook length allows a small space between the inside surface of the hooks and the container door rods 20 and 22. The hooks 40 and 42 are typically a distance of about one and one-half inches (1.5") behind the surface of the tubular members 44 and 46 which forms the main body of the locking device 10.

The length of the telescoping tubular members installed on or against the container door surface is shortened to span the basic rod spacing when the device 10 is locked in position on the doors. The width of the hooks and the two telescoped tubular members is about two inches (2"). The thickness of the metal stock is typically about 0.3" or greater. These representative dimensions, combined with the strength of the preferred construction material, give the locking device 10 great resistance to any attempt to pry the device off of the container rods 20 and 22 once it is locked in place. The hooks 40 and 42 and the main body of the device are also too thick to be cut by ordinary heavy duty bolt cutters which are used to snip the hasp of padlocks.

The two halves of the device 10 are mated together as described above by sliding the smaller tubular member 44 inside the larger one. The smaller of the two portions is also drilled with holes at regular and spaced intervals. These holes 48 and 50 are spaced suitable intervals measured from the center of each hole 48. The outer tubular member 46 has a large front hole drilled in it at 52 which is located near the middle of the assembled locking device 10. These holes 48, 50 and 52 align for a locking mechanism 54 to connect the three holes 48, 50 and 52 to hold tubular members 44 and 46 and prevents the portions from sliding relative to one another once the cylindrical locking mechanism 54 is stabbed through the aligned holes 48, 50 and 52. The cutaway of FIG. 2 shows views of the several holes in the smaller tubular member 44 and the single front hole 52 in the larger tubular member 46. A circular and overhanging shroud is affixed to the larger tubular member to protect the locking mechanism 54 from tampering or lateral hammering.

In the preferred embodiment, the lock mechanism 54 preferably operates with a round or hex key which inserts into it for unlocking. This bought item is preferably constructed with an outer cylindrical shell and a central portion within that shell which rotates only at the urging of the key. The inner portion incorporates a centralized stub shaft equipped with threads so that it may thread to the frame member 46 at the far side. The shroud and the hole 52 define an internal shoulder which provides a registration surface for the cylindrical lock mechanism. It is therefore installed and placed in the correct position by simple threading until the lock mechanism 52 threads up to the shoulder at the hole 52. Removal of the key locks the rotatable and external sleeve of the lock together so that it will no longer rotate. To prevent rotation of the entire lock after installation, the hole 48 is non-round meaning that it has a flat, or is cut in the form of a hex, square, etc. It conforms to the shape or profile of the outer shell or housing of the lock to forbid rotation.

This type of construction of a lock is installed by insertion in to the opening 48; preferably it has threads at the distal end to enable the lock to thread to the opposite side wall. Threading to the opposite side wall is accomplished by using a key to rotate the lock until threading is completed and the lock has been rotated until installed.

Installation of the locking device 10 is accomplished in the following manner. By means of a key, the lock is unthreaded and removed completely. This permits the left and right tubular frame members to be pulled completely apart. With a deft hand motion, the two separated halves are clasped on opposite sides of the vertical bars or rods 20 and 22 at the back of the trailer and then the two tubular members are telescoped together by fitting the tubular member 44 on the interior as shown in dotted line of FIG. 2. They are moved sufficiently close together to enable the two items to telescope. When the spacing is sufficiently tight to clasp the vertical rods on the doors, respective holes are aligned and the lock is then inserted through the hole 52 and is pushed as far into the hole 50 as possible. The exterior of the lock will not rotate; the interior does rotate with the key, and on rotation, the threads make up with the threaded hole snugging up the lock. When threads are fully engaged, threading is stopped because the lock mechanism shoulders up, and the key can then be removed.

With the use of several different holes along the two telescoping tubular members, the full width of the device 10 can be varied substantially so that it will accommodate different rod spacings. It is easily locked and left in place with simple hand manipulation of the two portions as shown in FIG. 2 and simple rotative threading of the lock mechanism to the locked position; removal and retrieval of course is achieved in the opposite fashion. While the foregoing is directed to the preferred embodiment, scope thereof is determined by the claims which follow:

What is claimed is:

1. An apparatus for locking the rear doors of a tractor trailer or ship container by grasping the two large parallel rods used to secure the rear doors, said apparatus comprising:

(a) a first hollow elongate rectangular tubular member;

(b) a second elongate rectangular member sized to axially fit within said first member;

(c) first and second clasping hooks of flat metal stock secured to the distal ends of said first and second members respectively to enable said hooks to lock around the door rods;

(d) lock mounting holes formed in said first member in the walls thereof wherein said first member has an exposed front wall and a back wall and said holes define a lock mounting location on said first member;

(e) multiple holes along the length of said second member aligned selectively with said lock mounting holes to enable telescoping movement for locking on variation of spacing of said clasping hooks;

(f) lock means insertable into said lock mounting holes to a recessed locking position and also extending through a selected hole in said second member to lock said second member and said hooks in location; and (g) wherein said lock mounting holes mount said lock means in a recessed locking position to thereby protect said lock means within said first and second members.

2. The apparatus of claim 1 wherein said first and second members are hollow rectangular tubular members sized to telescope together; and a lock surrounding shroud around said lock mounting holes to enable said lock means to be positioned internally of said shroud to leave only an end portion thereof exposed.

3. The apparatus of claim 2 wherein said two telescoped members each comprise large tubular members sized to prevent cutting engagement with a bolt cutter.

4. The apparatus of claim 3 wherein said two telescoped members are formed of hollow tubular stock, and said hooks are formed of flat metal stock having a width common to the tubular stock.

5. The apparatus of claim 3 wherein said multiple holes which align on mating to define spacing of said hooks to lock around the door rods.

6. The apparatus of claim 2 wherein said surrounding shroud is cylindrical.

7. The apparatus of claim 6 wherein said lock means comprises a key operated cylindrical lock sized to fit within said lock mounting holes for snugly holding said cylindrical lock.

8. The apparatus of claim 7 wherein said lock means comprises a threaded connection to said lock mounting holes.

9. The apparatus of claim 8 wherein said shroud mounts an exposed area of said first member.

* * * * *